US006326342B1

(12) United States Patent
Greenhill-Hooper et al.

(10) Patent No.: US 6,326,342 B1
(45) Date of Patent: Dec. 4, 2001

(54) BLEACHING COMPOSITIONS

(75) Inventors: Michael J. Greenhill-Hooper, Petworth (GB); Fernando Rey-Garcia, Valencia (ES); Avelino Corma-Canos, Valencia (ES); Jose Luis Jorda-Moret, Valencia (ES)

(73) Assignee: U.S. Borax Inc., Valencia, CA (US)

( * ) Notice: Subject to any disclaimer, the term of this patent is extended or adjusted under 35 U.S.C. 154(b) by 0 days.

(21) Appl. No.: 09/555,696

(22) PCT Filed: Dec. 3, 1998

(86) PCT No.: PCT/GB98/03618

§ 371 Date: Aug. 22, 2000

§ 102(e) Date: Aug. 22, 2000

(87) PCT Pub. No.: WO99/28426

PCT Pub. Date: Jun. 10, 1999

(30) Foreign Application Priority Data

Dec. 3, 1997 (GB) ..... 9725614

(51) Int. Cl.[7] ..... C11D 7/38; C11D 7/54

(52) U.S. Cl. ..... 510/221; 510/220; 510/224; 510/311; 510/312; 510/372; 510/376; 510/378; 252/186.38; 252/186.33

(58) Field of Search ..... 510/220, 221, 510/224, 311, 312, 372, 376, 378; 252/186.33, 186.38; 8/111, 137; 134/25.2

(56) References Cited

U.S. PATENT DOCUMENTS

| | | | | |
|---|---|---|---|---|
| 4,100,095 | | 7/1978 | Hutchins et al. . | |
| 4,412,934 | | 11/1983 | Chung et al. . | |
| 4,864,041 | * | 9/1989 | Hill | 549/513 |
| 5,178,989 | * | 1/1993 | Heller et al. | 430/323 |
| 6,165,963 | * | 12/2000 | Delroisse et al. | 510/376 |

FOREIGN PATENT DOCUMENTS

| | | | |
|---|---|---|---|
| 2183814 | * | 2/1997 | (CA) . |
| 195 30 786 A1 | | 2/1997 | (DE) . |
| 0237111 A2 | | 9/1987 | (EP) . |
| 0272030 A2 | | 6/1988 | (EP) . |
| 0384503 A1 | | 8/1990 | (EP) . |
| 0392592 A2 | | 10/1990 | (EP) . |
| 0443651 A2 | | 8/1991 | (EP) . |
| 0458397 A2 | | 11/1991 | (EP) . |
| 0458398 A2 | | 11/1991 | (EP) . |
| 0549077 A1 | | 6/1993 | (EP) . |
| 761809 | * | 3/1997 | (EP) . |
| WO 92/06161 A1 | | 4/1992 | (WO) . |
| WO 96/23859 A1 | | 8/1996 | (WO) . |
| WO 96/23860 A1 | | 8/1996 | (WO) . |
| WO 96/23861 A1 | | 8/1996 | (WO) . |
| WO 97/00311 A1 | | 1/1997 | (WO) . |
| WO 97/00312 A1 | | 1/1997 | (WO) . |
| WO 95/26438 | * | 2/1997 | (WO) . |
| WO 97/07886 | * | 3/1997 | (WO) . |

OTHER PUBLICATIONS

Kozhevnikov, Ivan V., "Heteropoly Acids and Related Compounds as Catalysts for Fine Chemical Synthesis", Catal. Rev.—Sci. Eng., 37 (2), pp. 311–352 (1995), No Month Available.

Hill, Craig L. et al., "Homogeneous Catalysis by Transition Metal Oxygen Anion Clusters", Coordination Chemistry Reviews, 143, pp. 407–455 (1995), No Month Available.

Finke, Richard G. et al., "Trivalent Heteropoly Tungstate Derivatives," Inorg. Chem., 26, pp. 3886–3896 (1987), No Month Available.

Lane, Gregg A. et al., "Palladium (I) πRadicals, Electrochemical Preparation and Study of their Reaction Pathways", J. Am. Chem. Soc. (1987) 109, pp. 402–407, No Month Available.

(List continued on next page.)

*Primary Examiner*—Gregory Del Cotto
(74) *Attorney, Agent, or Firm*—Kurt R. Ganderup

(57) ABSTRACT

The invention relates to a bleaching composition.

In particular the invention provides a bleaching composition which comprises:

(i) a bleaching agent, and (ii) as bleach catalyst, a polyoxometalate of Keggin, Dawson or Finke structure and having the general formula (II)

$$(A')_{a'}(Co_{x'}Y_{y'}M_{m'}O_o).cH_2O \qquad (II)$$

wherein the or each A', which may be the same or different, is a cation;

a' has a value such that $(A')_a$, counters the anionic charge of $(Co_{x'}Y_{y'}M_{m'}O_o)$;

x' has a value of 0.25 to 4;

the or each Y, which may be the same or different, represents

P, Si or Co;

y' is 1 or 2;

o has a value of 34 to 68;

the or each M, which may be the same or different, represents

W, Mo, V, Nb or Ta;

m' has a value of between 9 and 18;

c has a value of between 0 and 84.

The bleaching compositions according to the invention have good bleaching performance and can be used without a bleach activator, e.g. at low temperatures.

18 Claims, No Drawings

OTHER PUBLICATIONS

Lyon, David K. et al., "Highly Oxidation Resistant Inorganic–Porphyrin Analogue Polyoxometalate Oxidation Catalysts", J. Am. Chem. Soc. (1991) 113 pp. 7209–7221, No Month Available.

Liu, Jingfu et al., "Trimetallo Derivatives of Lacunary 9–Tungstosilicate Heteropolyanions", J. Chem. Soc. Dalton Trans. (1992) pp. 1901–1906, No Month Available.

* cited by examiner

BLEACHING COMPOSITIONS

This invention relates to bleach catalysts for use in bleaching compositions which may be used in detergent or cleaning compositions.

Detergents designed for fabric cleaning applications frequently contain bleaching agents. The purpose of these is primarily to oxidise chemically, and consequently remove, certain types of ("bleachable") stains but also to kill bacteria, which can otherwise lead to the spread of disease and be detrimental to human health.

European laundry detergents usually contain oxygen-based bleaching agents such as sodium perborate or sodium percarbonate. These bleaches work well at temperatures above 60° C., but to boost their overall effectiveness at today's relatively low washing temperatures (40–60° C.), they are most commonly employed with so-called bleach activator compounds. The bleach activator, an example of which is the compound tetraacetylethylenediamine (TAED), is typically employed at a level of 3–6% in the detergent and reacts stoichiometrically with the persalt to yield a stronger oxidising agent, e.g. peracetic acid. This oxidant is better able to bleach stains than hydrogen peroxide and also has superior biocidal activity. However, there is considerable interest in reducing concentrations and reducing quantities of detergents by reducing the levels of high volume ingredients such as bleach, with a view to providing compositions containing less chemicals and at lower cost. Further, as washing temperatures continue to decline, as a result of the demand for greater energy efficiency, even the commercially used activated bleaching systems are becoming less attractive since their performance is known to decrease rapidly below 40° C. Another drawback of these types of activator is their significant cost contribution to the detergent formulation, especially in proportion to that of the persalt component.

The development of interfacially active bleach activators, which react with persalts to produce peracids which are in turn interfacially active has improved the performance of oxygen bleaches under certain conditions. The technology has meant that lower concentrations of the bleaching system in the wash liquor are needed to give equivalent performance since the bleach is effectively targeted to the stains. Sodium nonanoyloxybenzene sulphonate (NOBS) as described in U.S. Pat. No. 4,412,934 is an example of this type of activator. Although this disclosure has resulted in the successful introduction of perborate bleach-based detergents into the United States, where lower detergent concentrations are typically employed, and some improvement of detergent performance at temperatures below 40° C., further improvement is required.

Much effort is being expended in the search for new organic bleach activators, however at present none has emerged which fulfils all the requirements, which must include (I) significantly improved bleach activity below 40° C., (II) fast dissolving rate, (III) reduction in the cost of the overall bleach package, (IV) ease of processability into detergent formulations, (V) storage stability and compatibility with other detergent ingredients, (VI) non-toxic nature, and (VII), in the case of bleach activators for laundry use, lack of dye and fabric damage.

Another approach considered has been the use of pre-formed peracids as bleaches. Examples of these are diperoxydodecanedioic acid (DPDDA) and phthaloylaminoperoxycarboxylic acids. Although these, and other examples of pre-formed peracids, can lead to better bleaching performance than TAED-activated perborate, the peracids generally need stabilising coatings (as described for example in U.S. Pat. No. 4,100,095). Their use can also cause pin-hole damage to dyed fabrics and further is not currently attractive from a cost point of view.

Yet another approach taken within the detergents industry has been the use of bleach catalysts which work with oxygen bleaches such as sodium perborate or sodium percarbonate. EP-A-237,111 and EP-A-443,651 describe bleaching compositions comprising a water soluble complex of manganese with a multidentate ligand, such as hydroxycarboxylic acid and non-carboxylate polyhydroxy compounds respectively. EP-A-272,030 and EP-A-392,592 disclose Co(III)amine complexes (e.g. $[Co(NH_3)_5Cl]Cl_2$) and Co(bispyridylamine)$Cl_2$ complexes respectively, as effective catalysts for activating hydrogen peroxide compounds in removing stains from substrates, such as fabrics. Other patent specifications, for example WO96/23859, WO96/23860, WO96/23861, WO97/00311 and WO97/00312 disclose cobalt catalysts such as $[Co(NH_3)_5OAc]Cl_2$ to provide enhanced cleaning/bleaching benefits in automatic dishwashing detergents. These documents teach that, in general, the evidence points to cobalt catalysts making in particular poorer fabric bleach catalysts than manganese complexes. EP-A-458,397 and EP-A-458,398 describe other manganese-based bleach catalysts for enhancement to persalt bleaching of stains on fabrics during washing at temperatures below 40° C. EP-A-384,503 describes modifications made to metalloporphyrin catalysts, intended for use as bleach catalysts, which are intended to make them more stable against oxidation by oxidant (e.g. peroxyacid).

Polyoxometalates are salts or acids having inorganic cluster-like oxo-anions and may be formed from simple vanadium, niobium, tantalum, molybdenum or tungsten compounds under appropriate conditions in aqueous or organic media (see C. L. Hill & C. M. Prosser-McCarthy, Coordination Chemistry Reviews 143 (1995) 407–455, I. V. Kozhevnikov, Catal. Rev. Sci. Eng., 37(2) 311–352 (1995)).

EP-A-549,077 describes particular tungsten containing polyoxometalates which are considered to be good oxidising agents. Furthermore their use as additives in the detergency field is proposed.

WO97/07886 describes the use of manganese-containing polyoxometalates of specified formula as oxidation catalysts in detergent and cleaning agents.

Additionally EP-A-761,809 describes the use of polyoxometalates as bleach catalysts in bleaching agent compositions. In particular the polyoxometalates used are stated to be preferably of the general formula:

$$(Q)_q(A_aX_xM_mO_yZ_z(H_2O)_b).cH_2O \quad (I)$$

where the symbols Q, A, X, M, Z, q, a, x, m, z, b and c have the following meanings:

Q stands for one or more cations selected from the group comprising H, Li, K, Na, Rb, Cs, Ca, Mg, Sr, Ba, Al, $PR^1R^2R^3R^4$ and $NR^1R^2R^3R^4$ in which $R^1$, $R^2$, $R^3$ and $R^4$ are the same or different and represent H, $C_1$–$C_{20}$-alkyl, $C_5$–$C_8$-cycloalkyl or $C_6$–$C_{24}$ aryl;

q stands for a number from 1 to 60, and describes the charge of the anionic unit in monovalent counter-cations;

A stands for one or more transition metals from the $2^{nd}$ to $8^{th}$ subsidiary group;

a stands for a number from 0 to 10,

X stands for one or more atoms selected from the group comprising Sb, S, Se, Te, Bi, Ga, B, P, Si, Ge, F, Cl, Br and I;

x stands for a number from 0 to 10;

M stands for one or more transition metals selected from the group comprising Mo, W, Nb, Ta and V;

m stands for a number from 0.5 to 60;

Z stands for one or more anions selected from the group comprising $OH^-$, $F^-$, $Cl^-$, $Br^-$, $I^-$, $N_3^-$, $NO_3^-$, $ClO_4^-$, $NCS^-$, $SCN^-$, $PF_6^-$, $RSO_3^-$, $RSO_4^-$, $CF_3SO_3^-$, $BR_4^-$, $BF_4^-$, $CH_3COO^-$ where R equals H, $C_1$–$C_{20}$-alkyl, $C_5$–$C_8$-cycloalkyl or $C_6$–$C_{24}$ aryl;

z stands for a number from 0 to 10;

y stands for the number of oxygen atoms needed to compensate the structure/charge and b and c stand independently of one another for numbers from 0 to 50.

The preferred polyoxometalates according to EP-A-761, 809 are $Q_8[MnMo_6O_{24}]$ (Q=Na or $NMe_4$ or a mixture of the two)

$K_4[MnMo_6O_8(OH)_6]$ $(NH_4)_{10}[Mn_3Sb_2W_{19}O_{68}]$*

$Na_{17}[Mn_2Se_6W_{24}O_{94}Cl]$*

$Na_2(NMe_4)_2[Mn_2W_{12}O_{40}(OH)_2].12H_2O$ $(Na/K)_{10}[Mn_3Se_2W_{18}O_{66}]$*

$Na_8[MnW_{12}O_{40}(OH)_2].6H_2O$ $Na_6[MnW_{12}O_{40}(OH)_2].6H_2O$ $(Na)_7[MnMo_9O_{32}]$*

$(K)_7[MnMo_9O_{32}]$*

*=containing water molecules.

It has now surprisingly been found that particular cobalt polyoxometalates have high effectiveness as bleach catalysts in bleaching, particularly cleaning and detergent, compositions far superior to those of the prior art.

According to the present invention there is provided a bleaching composition comprising:

(i) a bleaching agent, and (ii) as bleach catalyst, a polyoxometalate of Keggin, Dawson or Finke structure and having the general formula (II)

$$(A')_{a'}(Co_{x'}Y_{y'}M_{m'}O_o).cH_2O \quad (II)$$

wherein the or each A', which may be the same or different, is a cation, suitably selected from the cations of H, alkali and alkaline earth metals, and elements of the first transition series, e.g. Mn, Fe, Co, and Ni, particularly Ni; Ag, Cd, Hg and quaternary ammonium and phosphonium cations of the formula $NR_1'R_2'R_3'R_4'$ and $PR_1'R_2'R_3'R_4'$ (wherein each of $R_1'$, $R_2'$, $R_3'$ and $R_4'$, which may be the same or different, is selected from H, $C_1$–$C_{20}$alkyl, $C_5$–$C_8$ cycloalkyl and $C_6$–$C_{24}$ aryl);

a' has a value such that $(A')_{a'}$ counters the anionic charge of $(Co_{x'}Y_{y'}M_{m'}O_o)$;

x' has a value of 0.25 to 4;

the or each Y, which may be the same or different, represents P, Si or Co;

y' is 1 or 2;

o has a value of 34 to 68;

the or each M, which may be the same or different, represents W, Mo, V, Nb or Ta;

m' has a value of 9 to 18; and c has a value of between 0 and 84, generally 0 to 80, and more generally 0 to 50.

The bleaching compositions according to the present invention have good bleaching performance, particularly at low temperatures. It is a particular, and surprising, advantage of Co-polyoxometalate-containing bleaching compositions according to the present invention that they have improved bleaching performance, particularly at lower temperatures compared with known Mn-polyoxometalate-containing bleaching compositions.

Generally speaking compared with known Mn-polyoxometalate containing bleaching compositions, the bleaching compositions according to the present invention will provide equivalent bleaching performance at the same level of bleaching composition but at a lower temperature or at the same temperature using less bleaching composition.

It is a particular and surprising advantage of the present invention that bleaching compositions in the absence of a bleach activator such as TAED show at low temperatures improved performance compared with known Mn-polyoxometalate-containing bleaching compositions together with bleach activator. Accordingly the bleaching compositions according to the present invention offer the possibility of use without bleach activator but still obtaining improved bleaching performance. Bleach activators can be expensive ingredients and their omission will represent a cost saving.

The compositions according to the invention may be used in general cleaning applications, e.g. for, generally automatic, dishwashing. However it is particularly surprising that the Co-polyoxometalate-containing bleaching agents according to the invention are suitable for use in laundry of fabrics. Such laundry can suitably be carried out at low temperatures, e.g. below 50° C., e.g. 20 to 40° C., or below.

The invention also provides use of a polyoxometalate of Keggin, Dawson or Finke structure and having general formula II as defined above as bleach catalyst in a cleaning or detergent composition.

The compounds used according to the invention may be described as cobalt substituted polyoxometalates based on the Keggin, Dawson or Finke structures, optionally in the presence of a lacunary precursor.

The bleaching catalyst of formula II according to the invention may also suitably be used as dye-transfer inhibitors in parallel with known bleaching catalysts.

Throughout the present specification, the term "polyoxometalate" is used to include both the polyacids (i.e. $A'=H^+$) and salts of polyacids.

The polyoxometalates of general formula (II) are heteropolyoxometalates.

In particular the polyoxometalates used according to the invention contain cobalt and optionally phosphorus or silica, in addition to the e.g. tungsten and molybdenum. The polyoxometalates used according to the present invention are of Keggin, Dawson or Finke structure. For example, J.Amer.Chem.Soc. 113, 1991, 7209, describes Keggin anions of the formula $[APW_{11}O_{39}]^{7-/8-}$ wherein A is zinc, cobalt, nickel or manganese, J.Amer.Chem.Soc. 109, 1987, 402 describes Dawson anions of the formula $[AP_2W_{17}O_{61}]^{7-/8-}$ where A is manganese, iron, cobalt, nickel, copper, and Inor. Chem., 26, 3886 (1987) describes the preparation and characterisation of anions of the Finke structure.

Particularly important to the present invention is the polyoxometalate anion.

The anion used according to the invention suitably contains cobalt in an octahedral position. Thus $Co_{x'}$ may be considered to correspond to the number of Co ions in available octahedral sites. For a Dawson structure there will generally be 1 or 2 cobalt(s) in octahedral position(s) and for Keggin structures 1 to 3. The Finke structure generally has 4 octahedral positions occupied by cobalt since this is required for stability.

The anion used may also contain cobalt in a tetrahedral position, when at least one Y represents Co. However this position is not considered as important for the purposes of catalytic activity.

The cobalt will normally be present in the form $Co^{2+}$. In the case of Keggin anions the cobalt can also be present as $Co^{3+}$. However, particularly for reasons of stability, the divalent form is generally to be preferred.

The anion is preferably of Dawson or Keggin structure.

When the anion is of Dawson structure generally x will be 1 or 2, and when it is of Keggin structure x' will generally be 1 to 3, preferably 1 or 2. As indicated above in the case of a Finke structure, x' will generally be 4.

The values of m' and o will depend upon the structure of the anion and the number of cobalt ions present in octahedral position(s) i.e. the value of x'.

For a mono Co-substituted (x'=1) Keggin structured anion m' is generally 11 and o is 39.

For a mono Co-substituted Dawson structured anion $m^1$ is generally 17 and o is 61. When the Dawson anion is di Co-substituted (x'=2) m' is generally 16 and o is 60.

As indicated in formula II above the bleach catalysts used according to the invention may have water molecules associated with them. This water is generally associated with the anion. The manner of association of the water may vary. Generally each cobalt in an octahedral position has a water molecule associated with it. Additionally linking water molecules may be present within the structure of the anions or as water of hydration.

x' may suitably be 1 to 4, e.g. 1 or 2.

M is preferably Mo, or more preferably W.

m' may suitably be 11, when o is 39, or 17 when o is 61, or 16 when o is 60.

If x' is 2 to 4, then Y is preferably not Co. If y' is 2, then Y is preferably not Co.

In the case of the Finke structure, m will be 18 and o 68.

Suitably c may be 1 to 20, e.g. 1 to 5 or 1 to 3.

According to a preferred embodiment in the polyoxometalate of formula (II), x' and y' are each 1.

According to other preferred embodiments the polyoxometalate of formula (II) is of Keggin structure, Y is Co, and x' and y' are each 1; or the polyoxometalate of formula (II) is of Dawson structure, Y is P or Si, x' is 1 and y' is 2, or Y is P or Si, and x' and y' are each 2; or the polyoxometalate of formula (II) is of Finke structure, Y is P, y' is 2 and x' is 4.

Suitable bleaching catalysts using according to the invention include those having anions of the formulae:

$$[SiW_{11}(Co.H_2O)O_{39}]^{6-}$$

$$[PW_{11}(Co.H_2O)O_{39}]^{5-}$$

$$[Co^{2+}(Co.H_2O)W_{11}O_{39}]^{8-}$$

$$[P_2W_{17}(Co.H_2O)O_{61}]^{8-}$$

$$[P_2(Co.H_2O)_2W_{16}O_{60}]^{10-};$$

each with or without further associated water.

Typical Keggin structured polyoxometalates of formula (II) may be of formula $$(A')_{(8-t+2x)/p}[(Co.H_2O)_xYM_{12-x}O_{40-x}].nH_2O$$

in which x is 1 to 4, preferably 1 to 3, n is 0 to 80, p is the charge of the countercation A', and Y is the central atom and is as defined above, and t is its oxidation state.

Typical Dawson structured polyoxometalates of formula (II) may be of formula $$(A')_{(16-2t+2x)/p}[(Co.H_2O)_xY_2M_{18-x}O_{62-x}].nH_2O$$

in which x is 1 to 4, n is 0 to 80, p is the charge of the countercation A', and Y is the central atom and is as defined above, and t is its oxidation state.

Typical Finke structured polyoxometalates of formula (II) may be of formula $$(A')_{10/p}[P_2W_{18}Co_4(H_2O)_2O_{68}].nH_2O$$

in which n is 0 to 80, and p is the charge of the countercation A'.

The nature of the cation or cations A' of the bleaching catalysts used according to the invention is not as critical as that of the anion. For use as a bleaching catalyst the compound of formula II must of course be soluble or capable of being solubilized in water. Thus the cation(s) A' should be soluble or capable of being solubilized in use. For example in the case of quaternary ammonium cations these may be substituted by solubilising groups.

In the polyoxometalates according to the present invention, A' is suitably hydrogen, an alkali metal, e.g. potassium or sodium, or quaternary ammonium cation.

In particular, polyoxometalates which may be used as bleach catalysts according to the present invention include the following:

$$K_6[Si(Co.H_2O)W_{11}O_{39}]$$

$$K_4Na_2[Si(Co.H_2O)W_{11}O_{39}]$$

$$K_7H[Co^{2+}(Co.H_2O)W_{11}O_{39}].15H_2O$$

$$K_{10}[P_2(Co.H_2O)_2W_{16}O_{60}]$$

$$K_7H[P_2(Co.H_2O)W_{17}O_{61}]$$

$$[(CH_3)_4N]_5[PW_{11}(Co.H_2O)O_{39}]$$

$$[(C_2H_5)_3CH_3N]_5[PW_{11}(Co.H_2O)O_{39}]$$

$$[(C_3H_7)_4N]_5[PW_{11}(Co.H_2O)O_{39}]$$

$$[(C_4H_9)_4N]_5[PW_{11}(Co.H_2O)O_{39}]$$

The bleach catalysts used according to the present invention are one component of a bleaching composition which also contains as bleaching agent, a peroxygen bleach capable of liberating hydrogen peroxide in aqueous solution, preferably sodium perborate or sodium percarbonate.

The bleaching compositions according to the invention may also contain a bleach activator compound, selected from, for example, tetraacetylethylenediamine, pentaacetylglucose, sodium nonanoyloxybenzene sulphonate, benzoyloxybenzenesulphonate and other acylating activator compounds known to react with hydrogen peroxide to form a peroxyacid bleach. It is however a particular advantage of the present invention that the bleaching compositions may omit bleach activators.

The bleach catalysts of the invention may also be used with preformed peroxyacid bleaches, examples of which include phthaloylaminoperoxycarboxylic acids, mono- and diperoxycarboxylic acids.

The bleaching compositions according to the invention can be part of detergent or cleaning compositions and bleach booster compositions.

The detergent compositions may contain a surfactant, for example, an anionic surfactant such as an alcohol sulphate or linear alkyl benzene sulphonate and/or non-ionic surfactants, such as an alcohol ethoxylate.

In addition, the detergent compositions according to the invention will generally contain builders such as aluminosilicates (e.g. zeolite A), layered silicates, phosphates particularly sodium tripolyphosphate, trisodium citrate, sodium carbonate or sodium borate.

Equally, there may be present polymeric additives such as maleic/acrylic copolymers which act as co-builders, and soil release polymers such as polyethylene oxide terephthalate.

The detergent compositions according to the invention may also contain suds suppressors such as soap; enzymes such as lipase, amylase, cellulase and protease; optical brighteners such as stilbene derivatives, sequestrants and flow aids/fillers such as sodium sulphate.

More detailed information on typical detergent compositions is disclosed in, for example, WO92/06161.

The preferred weight ratio of peroxy compound to bleach catalyst in the bleaching compositions according to the invention will be between 10:1 and 1000:1, e.g. 50:1 and 1000:1.

The weight ratio of the peroxy compound to the bleach activator, if used, in the bleaching composition will generally be between 1:0, e.g. 1:1 and 20:1.

The bleaching composition according to the invention when it forms parts of a detergent or cleaning composition, may comprise between 1 and 50 wt. %, preferably between 1 and 30 wt. % of the detergent or cleaning composition. For bleach booster compositions, the major component, that is more than 50 wt/%, would be the bleaching composition according to the invention.

The invention is further described in the following Examples.

EXAMPLE 1

Synthesis of $K_6[SiW_{11}CoO_{39}].H_2O$ (Catalyst 1)

Method A

In the synthesis of this Co substituted Keggin heteropolyanion, firstly a lacunary precursor was prepared and in a second stage, the Co was incorporated. The complete synthesis procedure was as follows:

(a) Preparation of Lacunary Precursor: $Na_9H[SiW_9O_{34}].23H_2O$ 0.989 g of a solution containing 8.13 wt. % $Na_2O$, 24.31 wt. % $SiO_2$ and 67.56 wt. %, water was diluted with 16.94 g water. To this solution, 11.87 g of $Na_2WO_4.4H_2O$ were added. The solution thus prepared contained components with the following mole ratios:

$Na_2SiO_3:9Na_2WO_4.2H_2O:227H_2O$

To this solution, 6.757 g of hydrochloric acid (6M) were added very slowly under vigorous stirring. The appropriate amount of hydrochloric acid was added to obtain a $H^+/Si$ ratio of 10:1. The unreacted silica was filtered off.

The remaining solution was allowed to stand at room temperature for five days after which time well defined crystals had formed. These were collected by filtration and washed in cold water. They were then purified by dissolving in water and repeating the recrystallisation process twice.

The solid was then dried for one week at room temperature in a desiccator containing silica gel. The product was characterised by chemical analysis, X-Ray Diffraction (XRD) and Infra-Red (IR) spectroscopy. Chemical Analysis Data on Lacunary Precursor:

| Element | Predicted (wt. %) | Found (wt %) | Ratio (M/Si) |
|---|---|---|---|
| Si | 1.0 | 0.9 | 1.0 |
| W | 58.1 | 57.7 | 9.8 |
| Na | 7.3 | 6.4 | 8.7 |

Characteristic Bands in IR Spectrum of Lacunary Precursor (wave number/$cm^{-1}$):

| | | | | | | | |
|---|---|---|---|---|---|---|---|
| Predicted | 990 (m) | 935 (m) | 865 (vs) | 800 (s) | 745 (s) | 535 (m) | 315 (s) |
| Found | 993 | 938 | 869 | 804 | 749 | 532 | — |

(b) Synthesis of $K_6[SiW_{11}CoO_{39}].H_2O$ from Lacunary Precursor

The lacunary precursor polyoxometalate $Na_9H[SiW_9O_{34}].23H_2O$(1.12 g) was added very slowly, in powder form, to an aqueous solution of cobalt (II) acetate (0.30 g of cobalt (II) acetate dissolved in 10 g of water), having previously adjusted the solution pH to 6.5 with glacial acetic acid. After stirring for 15 minutes, the remaining traces of unreacted solid material were filtered off. The resulting solution was passed three times through a cation exchange resin (Dowex 50 WX8, 6 g) previously conditioned by treatment with a mixed solution of sodium acetate and acetic acid (pH 6.7) to effect the exchange of $Co^{2+}$ ions by $Na^+$. Potassium chloride (5 g) was added to the solution containing the sodium polyoxometalate.

The solution was then left for two weeks at room temperature to enable the product to crystallise. The formed crystals were then filtered, washed in cold water/ethanol (1:1) and dried at room temperature. 0.75 g of pink product was obtained.

The product was characterised by its IR spectrum, which matched that previously published for this material (see J. G. Liu et al, J. Chem. Soc., Dalton Trans., 12, 1901 (1992.)

Method B

As in Method A, firstly a lacunary precursor was prepared and in a second stage, the Co was incorporated. This synthesis procedure is scaled up compared with Method A.

(a) Synthesis of Lacunary $Na_9H[SiW_9O_{34}]$ Precursor 5.00 g (20.25 mmol) of $Na_2SiO_3$ ($Na_2SiO_3$ has the following composition 8.13 wt % $Na_2O$, 24.31 wt % $SiO_2$, 67.56 wt % water) were dissolved in 82.59 g of water and then, 60 g (204.18 mmol) of $Na_2WO_4$ were added to this solution. The mixture was stirred for 10 minutes until complete solution was obtained. Then, 33.87 ml of a solution 6M HCl were added very slowly under continuous stirring while some precipitate appears. The stirring was continued for a further 15 minutes, and then the solid was removed from the solution by filtration.

The solution was left for crystallization at room temperature and crystals were recovered periodically by filtration. Crystallisation was stopped after several days when approximately 10 g of precursor had been obtained. The IR spectrum obtained from this solid was consistent with that for the precursor of Method A.

(b) Synthesis of Cobalt Containing Polyoxometalate Having the Keggin Structure 9.81 g (4.02 mmol) of the above precursor were added to a solution containing 2.63 g (10.56 mmol) of $Co(CH_3COO)_2.4H_2O$ in 87.59 g of water, which solution has its pH previously adjusted to 6.5 by adding a few drops of acetic acid. A very intense red colour appeared after the precursor was added to the solution indicating that reaction occurred. The solution was stirred for 15 minutes to allow the lacunary heteropolyanion to react completely.

The insoluble solid was filtered off and the red solution was passed through a $Na^+$-exchanged resin DOWEX 50WX8. (Previously, the resin was conditioned by treating with a sodium acetate/acetic acid solution (0.1/0.1M)). The ion exchange step was repeated three times in order to exchange completely the $Co^{2+}$ cations, which compensate the charge of the Keggin anion at this stage, by $Na^+$ cations.

Then, 10 g (134.14 mmol) of KCl were added very slowly to the red solution under vigorous stirring. A pink precipitate appeared which was recovered by filtration, washed with 10 ml of distilled water and dried at room temperature by passing air through the solid, overnight.

Finally, 9.88 g (3.31 mmol, yield:82%) of solid was collected.

Chemical analysis indicated that the Keggin polyoxometalate did not precipitate as the pure potassium salt, $K_6[SiW_{11}(Co.H_2O)O_{39}]$, but it is partially compensated by sodium, having the analytic formula calculated $K_4Na_2[SiW_{11}(Co.H_2O)O_{39}]$.

Chemical Analysis of the Co-containing Keggin Polyoxometalate

| | Co (wt %) | K (wt %) | Na (wt %) | K/Co ratio | Na/Co ratio |
|---|---|---|---|---|---|
| Predicted | | | | | |
| $K_6[SiW_{11}(Co.H_2O)O_{39}]$ | 2.0 | 7.8 | — | 6 | — |
| $K_4Na_2[SiW_{11}(Co.H_2O)O_{39}]$ | 2.0 | 5.8 | 1.6 | 4 | 2 |
| Found | 2.1 | 5.8 | 1.5 | 4.2 | 1.8 |

The IR spectrum of the product was consistent with that of the product of Method A.

Method C

This, unlike Methods A and B, is a one step synthesis. The synthesis procedure was as follows:

A solution containing 3.15 g (52.5 mmol) of glacial acetic acid and 11.5 g (4 mmol) of $H_2SiW_{12}O_{40}.xH_2O$ in 25 g of distilled water was formed. Then, 6.12 g (61.2 mmol) of $KHCO_3$ were added to lower the pH of the solution to 6. When this pH had been reached, the solution was heated close to boiling point and a hot solution containing 0.8 g (3.1 mmol) of cobalt acetate tetrahydrate ($CoAc_2.4H_2O$) and 2 g of water were added. Subsequently, 15 g (153.1 mmol) of potassium acetate and 0.5 g (8.3 mmol) of AcOH dissolved in 8 g of water was added and the solution was stirred for 15 minutes and filtered.

The solution was left to stand for 4 hours and 8.1 g of a deep red solid were recovered by filtration. 2 g of this product were recrystallised by dissolving in boiling water. After cooling to room temperature and standing for two hours, 1.42 g of very large deep red crystals were collected. Chemical analysis of product.

| | Co (wt %) | K (wt %) | Si (wt %) | Co/Si | K/Si |
|---|---|---|---|---|---|
| Predicted | 2.0 | 7.8 | 0.94 | 1 | 6 |
| Found | 1.9 | 6.9 | 0.91 | 0.97 | 5.5 |

EXAMPLE 2

Synthesis of $[(CH_3)_4N]_5[PW_{11}CoO_{39}].H_2O$ (Catalyst 2)

(a) Preparation of Lacunary Precursor $Na_9H[PW_9O_{34}].19H_2O$ 30 g of sodium metatungstate were dissolved in 37 ml of distilled water. Next, 0.75 ml of phosphoric acid (85 wt. %) were added dropwise to the solution. This was followed by 5.5 ml of glacial acetic acid, whereupon precipitation of the target lacunary heteropolyanion $Na_9H[PW_9O_{34}].19H_2O$ occurred. The resulting solid was recovered by filtration and washed with a very small amount of water and dried under vacuum.

(b) Synthesis of $[(CH_3)_4N]_5[PW_{11}CoO_{39}].H_2O$ from Lacunary Precursor 10 g of the above lacunary precursor polyoxometalate, $Na_9H[PW_9O_{34}].19H_2O$, was dissolved in 100 ml of water, then 2 ml of glacial acetic acid and 1.8 g of cobalt (II) acetate were added. The resulting solution was refluxed for two hours. Some insoluble solid material was removed by filtration at high temperature (close to the boiling point). Finally, 40 ml of a saturated solution of tetramethylammonium bromide were added to the solution. Upon lowering the temperature of the solution, a solid precipitated which was collected by filtration and purified by successive water washing.

The polyoxometalate was characterised by ultra violet (UV)/Visible, IR spectroscopy and chemical analysis. Bands at 249 and around 500 nm in the UV/Visible region, and at 715, 750, 787, 820, 886, 956, 1077 and 1057 $cm^{-1}$ in the IR region are shown, which are characteristic of the target cobalt substituted polyoxometalate.

Chemical Analysis Data on Catalyst 2

| | Co | P | W | C | N | H |
|---|---|---|---|---|---|---|
| Predicted | 1.90 | 1.00 | 64.98 | 7.75 | 2.26 | 2.00 |
| Found | 1.5 | 1.01 | 73.15 | 7.57 | 2.15 | 1.97 |

EXAMPLES 3–6

3. $[(C_2H_5)_3CH_3N]_5[PW_{11}CoO_{39}].H_2O$ (Catalyst 3)
4. $[(C_3H_7)_4N]_5[PW_{11}CoO_{39}].H_2O$ (Catalyst 4)
5. $[(C_4H_9)_4N]_5[PW_{11}CoO_{39}].H_2O$ (Catalyst 5)
6. $[C_{14}H_{29}(CH_3)_3N]_5[PW_{11}CoO_{39}].H_2O$ (Catalyst 6)

The polyoxometalates were synthesised using the method described in Example 2 with the exception that the final addition of 40 ml of a saturated solution of a tetraalkylammonium bromide was triethylmethylamaonium bromide for Example 3, tetrapropylammonium bromide for Example 4, tetrabutylammonium bromide for Example 5, and tetradecyl trimethylammonium bromide for Example 6.

The polyoxometalates formed were characterised by chemical analysis, UV/Visible and IR spectroscopy.

Chemical Analysis Data on Catalysts 3–6

| | Co | P | W | C | N | H |
|---|---|---|---|---|---|---|
| Catalyst 3 | | | | | | |
| Predicted | | | | 12.71 | 2.12 | 2.78 |
| Found | | | | 12.53 | 2.09 | 2.70 |
| Catalyst 4 | | | | | | |
| Predicted | 1.61 | 0.85 | 55.02 | 19.70 | 1.92 | 3.88 |
| Found | 1.57 | 0.86 | 59.50 | 16.3 | 1.61 | 3.31 |
| Catalyst 5 | | | | | | |
| Predicted | | | | 24.40 | 1.78 | 4.62 |
| Found | | | | 20.50 | 1.53 | 3.80 |
| Catalyst 6 | | | | | | |
| Predicted | | | | 25.5 | 1.75 | 4.79 |
| Found | | | | 27.7 | 1.92 | 5.33 |

EXAMPLE 7

Synthesis of $K_7H[Co(II)\ (Co(II).H_2O)W_{11}O_{39}].15H_2O$. (Catalyst 7)

19.8 g of $Na_2WO_4.2H_2O$ were dissolved in 40 g of distilled water. Then, the pH was adjusted to 7 by adding 3.5 g acetic acid. The resulting colourless solution was heated at 120° C. under continuous stirring and 2.5 g of $Co(CH_3COO)_2.4H_2O$ dissolved in 13 g of water were dropped in the solution using an addition funnel. The initially colourless solution became immediately dark blue, which later slowly changed to green over approximately 15 minutes as the reaction progressed.

The resulting green solution was cooled and the insoluble solid was filtered off. The solution was heated to 120° C. and a hot solution a containing 13 g of KCl in 25 g of water was added. The heating was maintained for 15 minutes and then the solution was cooled to room temperature. The solution was kept at 5° C., overnight for crystallisation. After that, 17.4 g of a green solid were collected.

3 g of this solid was recrystallised by dissolving in 10 ml of 0.08M acetic acid at 100° C. Insoluble solid was filtered off and the green solution was cooled to room temperature. Then, 10 ml of a saturated solution of KCl in water were added. The resulting solution was crystallised at 5° C., overnight. The solid was recovered and dried at room temperature by fluxing air. The recrystallisation process was repeated twice. 1.68 g of solid were obtained.

Chemical Analysis Data on Product

| | Co (wt %) | K (wt %) | K/Co ratio |
|---|---|---|---|
| Predicted | 3.5 | 8.2 | 3.5 |
| Found | 3.1 | 7.5 | 3.6 |

EXAMPLE 8

Synthesis of $K_7H[P_2W_{17}CoO_{61}.H_2O]$ (Catalyst 8)

The synthesis of this Dawson structure containing one Co(II) isomorphically incorporated into the octahedral position replacing a tungsten atom was carried out in two steps. In the first step, the Dawson polyoxometalate $K_6[P_2W_{18}O_{62}].14H_2O$ containing no cobalt was prepared. Then in the second step, one tungsten at om was isomorphically replaced by a cobalt atom.

(a) Preparation of the precursor $K_6[P_2W_{18}O_{62}].14H_2.O$.

10 g of $Na_2WO_4.2H_2O$ were dissolved in 35 ml of boiling distilled water. Then, 25.7 g of $H_3PO_4$ (85 wt %) were added and the resulting solution was refluxed for 5 hours.

After cooling the solution to room temperature, 10 g of KCl were added. Immediately, a yellowish precipitate appears, that was recovered by filtration. A portion of this solid was recrystallised at 5° C., overnight. The solid was dried at room temperature in air. The IR spectrum and chemical analysis indicated that the Dawson Polyoxometalate was successfully prepared. No differences were observed between the solids before and after recrystallisation. For the further preparation non-recrystallised material was used.

(b) Synthesis of the $K_7H[P_2W_{17}(Co.H_2O)O_{61}]$

A solution containing 5 g of the Dawson precursor in 20 g of distilled water was heated at 120° C. Then, 0.357 g of $CoCl_2.6H_2O$ dissolved in the minimum amount of water were added. After stirring for 5 minutes at 80° C., a solution of 4 g potassium acetate in 5 g of water was added and the pH was adjusted to 7 by adding acetic acid.

The resulting solution was stirred at 120° C. for 10 min and changed colour from blue to brown-reddish. The solid was recovered by filtration. The solid was refluxed in 20 g of boiling water at 120° C. for 20 minutes. After that, the solid was nearly dissolved. Some impurities were removed by hot filtration and the remaining intense brown-red solution was crystallised at 5° C. overnight. A large quantity (2.59 g) of small needle shaped crystals were recovered by filtration. This solid was identified as the desired $K_7H[P_2W_{17}(Co.H_2O)O_{61}]$ polyoxometalate.

Chemical analysis showed that a Dawson polyoxometalate having one Co isomorphically substituted in an octahedral position was obtained.

Chemical Composition of $K_7H[P_2W_{17}(Co.H_2O)O_{61}]$ Polyoxometalate

| Sample | Co (wt %) | K (wt %) | K/W molar ratio |
|---|---|---|---|
| Predicted | 1.3 | 6.1 | 7.0 |
| Found | 1.2 | 5.5 | 6.9 |

EXAMPLE 9

The performance of each of the bleaching compositions listed in Table 1 below was assessed in washing tests using the Terg-o-tometer (United States Testing Co.). In the test, 4 10 cmx10 cm swatches of BCl (CFT-Netherlands) tea stained cotton were washed in 1 litre of demineralised water containing the bleaching components for 31 minutes. In samples 1–4 the wash solutions contained $8.6\times10^{-3}$ $mol.dm^{-3}$ hydrogen peroxide and $8.6\times10^{-3}$ $mol.dm^{-3}$ sodium metaborate ($NaBO_2.4H_2O$) to simulate the use of sodium perborate.

In samples 5–8, the wash solutions contained $8.6\times10^{-3}$ $mol.dm^{-3}$ hydrogen peroxide and $5.7\times10^{-3}$ $mol.dm^{-3}$ sodium hydrogen carbonate to simulate the use of sodium percarbonate.

The temperature of the wash was either 20 or 40° C.

The pH of the wash liquor was maintained at 10.

After the wash cycle, the swatches were rinsed (twice) in 1 litre of demineralised water, wrung out and dried in a fan oven (50° C., 2 hours).

The differences between the pre- and post-wash reflectances of the swatches at 460 nm were calculated and the resultant quantity, ΔR460, averaged over the four swatches, used to provide an indication of stain removal.

The results are shown in Table 1 below:

TABLE 1

| Bleaching Composition | | | ΔR460 | |
|---|---|---|---|---|
| Samples | TAED/g | Catalyst 1/mg | 20° C. | 40° C. |
| 1 (Comparative) | 0.15 | 0 | 4.56 | 7.95 |
| 2 | 0.15 | 10 | 7.28 | 15.40 |
| 3 (Comparative) | 0.388 | 0 | 5.92 | 12.36 |
| 4 | 0.388 | 10 | 10.75 | 13.29 |
| 5 (Comparative) | 0.15 | 0 | 5.92 | 10.74 |
| 6 | 0.15 | 10 | 8.82 | 12.87 |
| 7 (Comparative) | 0.388 | 0 | 6.75 | 8.70 |
| 8 | 0.388 | 10 | 8.63 | 10.91 |

A pronounced and unexpected improvement in the bleaching performance of TAED-activated perborate and percarbonate is shown with the addition of Catalyst 1 of Example 1. The effect is particularly striking at 20° C.

EXAMPLE 10

An analogous manganese catalyst to Catalyst 1 was prepared. The method A disclosed in Example 1 was followed but instead of cobalt (II) acetate an equivalent molar quantity of manganese (II) acetate was used. A product having the approximate composition $K_{10}[SiW_9Mn_3O_{37}].3H_2O$ (Mn-catalyst 1) was obtained.

The low temperature (20° C.) tea stain bleaching performance of Catalyst 1 was then compared with that of the manganese catalyst following the procedure using perborate described in Example 9.

The results are shown in Table 2.

TABLE 2

| Catalyst | TAED/g | ΔR460 |
|---|---|---|
| Catalyst 1 | 0.388 | 10.75 |
| Mn-Catalyst 1 | 0.388 | 9.50 |

EXAMPLE 11

The performance of Catalysts 1 to 5 synthesised and identified in Examples 1–5 was assessed in Terg-o-tometer washing tests against an oily stain (Mayonnaise-annato CS-5S, CFT-Netherlands) at 20° C. 10 mg of each catalyst, 0.15 g TAED and perborate under the conditions described in Example 9 were employed.

The results are shown in Table 3.

TABLE 3

| Catalyst | ΔR460 |
|---|---|
| None | 7.23 |
| Catalyst 1 | 9.48 |
| Catalyst 2 | 8.56 |

TABLE 3-continued

| Catalyst | ΔR460 |
|---|---|
| Catalyst 3 | 8.65 |
| Catalyst 4 | 8.18 |
| Catalyst 5 | 8.86 |

EXAMPLE 12

The performance of each of the Catalyst 1-containing bleaching compositions listed in Table 4 below was assessed in washing tests using the Terg-o-tometer (United States Testing Co.). In the test, 4 10 cm×10 cm swatches of BCl (CFT-Netherlands) tea stained cotton were washed in 1 litre of demineralised water containing the bleaching components for 31 minutes. The wash solutions used contained $8.6\times10^{-3}$ mol.dm$^{-3}$ hydrogen peroxide and $8.6\times10^{-3}$ mol.dm$^{-3}$ sodium metaborate ($NaBO_2.4H_2O$) to simulate the use of sodium perborate, 10 mg/L Catalyst 1 and TAED as indicated in Table 4.

The temperature of the wash was either 20 or 40° C.

The pH of the wash liquor was maintained at 10.

After the wash cycle, the swatches were rinsed (twice) in 1 litre of demineralised water, wrung out and dried in a fan oven (50° C., 2 hours).

The difference between the pre- and post-wash reflectances using catalyst were measured and the resultant quantity, ΔR460, calculated as in Example 9. Similarly the corresponding ΔR460 figure without catalyst was obtained. The ΔR460 without catalyst was subtracted from that with catalyst. The resulting figure, ΔR460' below, provides an indication of stain removal attributable to the catalyst.

The results are shown in Table 4 below:

TABLE 4

| | ΔR460' | |
|---|---|---|
| TAED g/L | 20° C. | 40° C. |
| 0 | 4.60 | 8.73 |
| 0.15 | 2.72 | 7.45 |
| 0.388 | 4.83 | 0.93 |

The results show that Catalyst 1 catalyses simulated perborate bleach (hydrogen peroxide in borate buffer) in the absence of TAED bleach activator.

EXAMPLE 13

Tea stain bleaching performance of managanese-containing polyoxometalates was measured following the procedure described in Example 12.

The managanese-containing polyoxometalates used were as follows:

Mn-Catalyst 1—as described Example 10 above.

Mn-Catalyst 2

$(NH4)_{10}[Mn_3Sb_2W_{19}O_{68}]$ was obtained according to the method of Example 1 of DE-A-195 30 786.

Mn-Catalyst 3

$Na_{17}[Mn_2Se_6W_{24}O_{94}Cl]$ was obtained according to the method of Example 5 of DE-A-195 30 786.

The results obtained, in comparison with those of Example 12, are shown in Table 5 below:

TABLE 5

| TAED g/L | Catalyst 1 ΔR460' | Mn-Catalyst 1 ΔR460' | Mn-Catalyst 2 ΔR460' | Mn-Catalyst 3 ΔR460' |
|---|---|---|---|---|
| Results at 20° C.: | | | | |
| 0 | 4.60 | 0.02 | −0.31 | −-0.22 |
| 0.15 | 2.72 | −0.07 | 2.34 | 1.29 |
| 0.388 | 4.83 | 3.58 | 2.15 | 0.65 |
| Results at 40° C.: | | | | |
| 0 | 8.73 | 1.65 | −0.50 | −1.43 |
| 0.15 | 7.45 | 0.99 | 4.57 | 3.75 |
| 0.388 | 0.93 | −1.42 | 2.40 | 0.58 |

In contrast to the Mn substituted polyoxometalate catalysts, Catalyst 1 did not require the presence of TAED bleach activator to realise its catalytic activity.

EXAMPLE 14

Wash tests were used to assess the effect of the use of various cobalt catalysts according to the invention and in comparison to manganese polyoxometalates upon bleaching performance on tea stains on cotton by sodium perborate monohydrate (PBS1) with and without TAED activator, in the presence of base detergent and using local tap water.

0.986g/L PBS1 and 2.0 g/L IEC-456 (phosphate-free) test detergent (1994 formula with foam inhibitor—supplied by Henkel Kga) were used. The tap water contained typically 67 ppm $Ca^{2+}$ and 3.0 ppm $Mg^{2+}$. Apart from these differences, the test procedure was as described in Example 12.

The results are shown in Table 6 below.

TABLE 6

| | 20° C. - ΔR460' | | 40° C. - ΔR460' | |
|---|---|---|---|---|
| TAED g/L | 0 | 0.15 | 0 | 0.5 |
| Catalyst 1 | 1.50 | 1.59 | 2.28 | 2.33 |
| Catalyst 7 | 1.80 | 1.29 | 1.97 | 1.34 |
| Catalyst 8 | 1.66 | 1.34 | 0.94 | 1.33 |
| Mn-Catalyst 1 | −0.14 | 1.10 | 1.06 | 1.76 |
| Mn-Catalyst 2 | 0.76 | 0.75 | −0.54 | 0.76 |
| Mn-Catalyst 3 | −0.34 | 0.84 | −1.04 | 0.50 |

The superior performance of the cobalt catalysts is apparent, especially in the absence of bleach activator.

EXAMPLE 15

Wash tests were carried out to compare the effect of the use of a cobalt containing catalyst according to the invention and a manganese polyoxometalate upon the bleaching of tea stains on cotton by simulated sodium perborate (8.6 mM) in the presence of 2 g/L IEC-456 base detergent and two levels of TAED activator (0.15 and 0.50 g/L) using tap water as in Example 14. Apart from these differences, the procedure was as described in Example 12.

The results are shown in Table 7 below:

TABLE 7

| | 20° C. - ΔR460' | | 40° C. - ΔR460' | |
|---|---|---|---|---|
| TAED g/L | 0.15 | 0.50 | 0.15 | 0.50 |
| Catalyst 1 | 4.05 | −0.61 | 2.66 | 0.06 |
| Mn-Catalyst 2 | 1.73 | 4.47 | 0.52 | 4.26 |

The performance of Catalyst 1 was low at very high added TAED, but was good at low TAED levels. This situation was reversed with the Mn-polyoxometalate.

A level of 0.5 g/L TAED represents a level which would be unacceptably high in conventional fabric washing processes. If delivered from a modern compact heavy duty laundry powder, the detergent would need to contain in excess of 10 wt. % TAED; a level which would be economically non-viable.

EXAMPLE 16

Wash tests were carried out to compare the effect of the use of a cobalt-containing catalyst according to the invention and a manganese polyoxometalate upon the bleaching of tea stains on cotton by PBS1, but employing half the level of PBS1 used in Example 14 (0.493 g/L). Test solutions also contained 2.0 g/L IEC-456 reference detergent, and either 0 or 0.15 g/L TAED. Tap water was used and the procedure was the same as in Example 14.

The results are shown in Table 8 below.

TABLE 8

| | 20° C. - ΔR460' | | 40° C. - ΔR460' | |
|---|---|---|---|---|
| TAED g/L | 0 | 0.15 | 0 | 0.15 |
| Catalyst 1 | 1.58 | 0.62 | 1.53 | 0.72 |
| Mn-Catalyst 2 | 0.32 | 0.85 | −0.47 | 1.13 |

Catalyst 1 is seen to give a significant boost to the performance of PBS1 at this lower level. Again, compared to a Mn-catalyst, the results are significantly better in the case where no TAED is included.

EXAMPLE 17

Wash tests were carried out to assess the effect of adding Catalyst 1 on the bleaching performance of PBS1 against other stains on cotton. 0.986 g/L PBS1, 2.0 g/L IEC-456 reference detergent and 0.15 g/L TAED were included in the test solutions. Tap water was used and the procedure in Example 14 was followed.

The results are shown in Table 9 below.

TABLE 9

| Stain | 20° C. - ΔR460' | 40° C. - ΔR460' |
|---|---|---|
| Coffee (CFT BC2) | 1.36 | 0.41 |
| Mayonnaise/annatto (CFT CS5) | 2.96 | 0.93 |

The effectiveness of Catalyst 1 in enhancing the perborate bleaching of both hydrophilic and lipophilic stains is demonstrated.

EXAMPLE 18

Wash tests were carried out to assess the effect of Catalyst 1 and a managanese-containing polyoxometalate on the bleaching by a PBS1-based detergent of several stains on cotton under US conditions. The test solution contained 1.5 g/L of 'Tide Free' detergent with 0.08 g/L PBS1 and 0.04 g/L sodium nonanoyloxybenzene sulphonate (NOBS). ['Tide Free' is a bleach free detergent ex Procter & Gamble].

The tests used tap water and the procedure in Example 16 was followed, except that the wash time was 15 minutes. Wash temperature was 50° C.

The results are shown in Table 10 below:

TABLE 10

| Catalyst | Coffee stain (CFT-BC2) | Mayonnaise/annatto stain (CFT-CS-5S) |
|---|---|---|
| Catalyst 1 | 0.80 | 0.95 |
| Mn-Catalyst 2 | −0.18 | −0.84 |

Enhancement of perborate bleaching is obtained with Catalyst 1 under US conditions.

EXAMPLE 19

This example demonstrates a method for incorporating catalysts of this invention onto an inert carrier, to facilitate their incorporation into a detergent powder.

1.956 g of Catalyst 1 were dissolved with gentle warming (50° C.) in 600 ml of demineralised water. The solution was transferred to a 1 litre rotary evaporator flask, to which 60 g of Sorbosil AS30 silica (Crosfield) was then added. The suspension was then evaporated to dryness (water vacuum, 70° C.) and an off-white, but homogeneous powder recovered. This was dried for 2 hours at 105° C. 54.0 g of this powder was then granulated in a domestic coffee grinder with 29 g of the nonionic surfactant Synperonic A9 (ICI Surfactants). The product was screened to obtain free flowing granules in the size range 500–1000 $\mu$m.

What is claimed is:

1. A bleaching composition comprising (i) a bleaching agent, and (ii) as bleach catalyst, a polyoxometalate of Keggin, Dawson or Finke structure and having the general formula (II)

$$(A')_{a'}(Co_{x'}Y_{y'}M_{m'}O_o).cH_2O \quad (II)$$

wherein the or each A', which may be the same or different, is a cation;

a' has a value such that $(A')_{a'}$ counters the anionic charge of $(Co_{x'}Y_{y'}M_{m'}O_o)$;

x' has a value of 0.25 to 4;

the or each Y, which may be the same or different, represents

P, Si or Co;

y' is 1 or 2;

o has a value of 34 to 68;

the or each M, which may be the same or different, represents W, Mo, V, Nb or Ta;

m' has a value of 9 to 18; and c has a value of between 0 and 84.

2. A bleaching composition according to claim 1, in which, in the polyoxometalate of formula (II), M is W or Mo.

3. A bleaching composition according to claim 1, in which, in the polyoxometalate of formula (II), x' is 1 to 4.

4. A bleaching composition according to claim 1, in which the polyoxometalate of formula (II) is of Keggin structure, Y is Co, and x' and y' are each 1.

5. A bleaching composition according to claim 1, in which the polyoxometalate of formula (II) is of Dawson structure, Y is P or Si, x' is 1 and y' is 2.

6. A bleaching composition according to claim 1, in which the polyoxometalate of formula (II) is of Dawson structure, Y is P or Si, and x' and y' are each 2.

7. A bleaching composition according to claim 1 in which, in the polyoxometalate of formula (II), m' is 11 and o is 39, m' is 17 and o is 61, or m' is 16 and o is 60.

8. A bleaching composition according to claim 1 in which, in the polyoxometalate of formula (II), the anion is of formula:

$[SiW_{11}(Co.H_2O)O_{39}]^{6-}$ $[PW_{11}(Co.H_2O)O_{39}]^{5-}$ $[Co^{2+}(Co.H_2O)W_{11}O_{39}]^{8-}$ $[P_2W_{17}(Co.H_2O)O_{61}]^{8-}$ $[P_2(Co.H_2O)_2W_{16}O_{60}]^{10-}$.

9. A bleaching composition according to claim 1 in which the or each A', which may be the same or different, is a cation selected from the cations of H, alkali and alkaline earth metals, elements of the first transition series, Ag, Cd, Hg, and quaternary ammonium and phosphonium cations of the formulae $NR_1'R_2'R_3'R_4'$ and $PR_1'R_2'R_3'R_4'$ wherein each of $R_1'$, $R_2'$, $R_3'$ and $R_4'$, which may be the same or different, is selected from the group consisting of H, $C_1$–$C_{20}$ alkyl, $C_5$–$C_8$ cycloalkyl and $C_6$–$C_{24}$ aryl.

10. A bleaching composition according to claim 9 in which the or each A' is H, K or Na.

11. A bleaching composition according to claim 1, in which the polyoxometalate of formula (II) is selected from:

$K_6[Si(Co.H_2O)W_{11}O_{39}]$ $K_4Na_2[Si(Co.H_2O)W_{11}O_{39}]$ $K_7H[Co^{2+}(Co.H_2O)W_{11}O_{39}].15H_2O$ $K_{10}[P_2(Co.H_2O)_2W_{16}O_{60}]$ $K_7H[P_2(Co.H_2O)W_{17}O_{61}]$ $[(CH_3)_4N]_5[PW_{11}(Co.H_2O)O_{39}]$ $[(C_2H_5)_3CH_3N]_5[PW_{11}(Co.H_2O)O_{39}]$ $[(C_3H_7)_4N]_5[PW_{11}(Co.H_2O)O_{39}]$ $[(C_4H_9)_4N]_5[PW_{11}(Co.H_2O)O_{39}]$.

12. A bleaching composition according to claim 1, in which the bleaching agent is $H_2O_2$, sodium perborate or sodium percarbonate.

13. A bleaching composition according to claim 1 which also contains a bleach activator.

14. A method for catalyzing bleaching comprising adding an effective amount of a polyoxometalate bleach catalyst to an aqueous bleaching composition comprising a bleaching agent, wherein said polyoxometalate bleach catalyst is a polyoxometalate of Keggin, Dawson, or Finke structure and has the (general formula (II)

$$(A')_{a'}(Co_{x'}Y_{y'}M_{m'}O_o).cH_2O \quad (II)$$

wherein the or each A', which may be the same or different, is a cation; a' has a value such that $(A')_{a'}$ counters the anionic charge of $(Co_{x'}Y_{y'}M_{m'}O_o)$; x' has a value of 0.25 to 4; the or each Y, which may be the same or different, represents P, Si, or Co; y' is 1 or 2; o has a value of 34 to 68; the or each M, which may be the same or different, represents W, Mo, V, Nb or Ta; m' has value of 9 to 18; and c has a value of between 0 and 84.

15. A method of inhibiting dye transfer in the laundering of fabric, said method comprising treating the fabric with an aqueous solution comprising a polyoxometalate as defined in claim 1.

16. A method for bleaching in the laundering of fabric, said method comprising treating the fabric with an aqueous laundry solution comprising an effective amount of a bleaching composition as defined in claim 1.

17. A detergent or cleaning composition containing, as bleaching composition, a composition as defined in claim 1.

18. A method for cleaning tableware in an automatic dishwashing appliance, said method comprising contacting the tableware with an aqueous washing solution comprising a bleaching composition as defined in claim 1.

* * * * *